US010114335B2

(12) United States Patent
Matsuno

(10) Patent No.: US 10,114,335 B2
(45) Date of Patent: Oct. 30, 2018

(54) PROCESS FRAME AND IMAGE FORMING APPARATUS COMPRISING SAME

(71) Applicant: KYOCERA Document Solutions Inc., Osaka (JP)

(72) Inventor: Akinori Matsuno, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/718,294

(22) Filed: Sep. 28, 2017

(65) Prior Publication Data

US 2018/0095419 A1 Apr. 5, 2018

(30) Foreign Application Priority Data

Oct. 4, 2016 (JP) ..... 2016-196529

(51) Int. Cl.
*G03G 21/18* (2006.01)
*G03G 21/16* (2006.01)

(52) U.S. Cl.
CPC ..... *G03G 21/1821* (2013.01); *G03G 21/1647* (2013.01); *G03G 21/1814* (2013.01); *G03G 2221/1654* (2013.01)

(58) Field of Classification Search
CPC ..... G03G 21/1821; G03G 21/1647; G03G 21/1814; G03G 2221/1654
See application file for complete search history.

(56) References Cited

U.S. PATENT DOCUMENTS

| | | | | |
|---|---|---|---|---|
| 9,389,542 | B2 | 7/2016 | Nakano et al. | |
| 9,400,480 | B2 * | 7/2016 | Itabashi | G03G 21/1647 |
| 2011/0229197 | A1 * | 9/2011 | Tada | G03G 21/1867 399/111 |
| 2011/0280620 | A1 * | 11/2011 | Chadani | G03G 21/1871 399/111 |
| 2017/0351199 | A1 * | 12/2017 | Mimura | G03G 15/1605 |

FOREIGN PATENT DOCUMENTS

| | | |
|---|---|---|
| JP | 2014-157381 A | 8/2014 |
| JP | 2016-004113 A | 1/2016 |

* cited by examiner

*Primary Examiner* — Rodney Bonnette
(74) *Attorney, Agent, or Firm* — Studebaker & Brackett PC

(57) ABSTRACT

An image forming apparatus includes a drum unit supporting a photosensitive drum, a development unit forming a toner image on the photosensitive drum and a process frame. In the process frame, after the drum unit is installed along a predetermined installation direction, the development unit is installed along the installation direction. The process frame includes a pair of two supporting parts supporting a pair of two supported parts provided in the development unit. One supporting part is configured so as to support one supported part along a direction intersecting the installation direction and to restrict movement of the one supported part along the installation direction. Other supporting part is configured to restrict movement of other supported part along the installation direction when, after the other supported part is supported along the installation direction, the drum unit is installed to the process frame.

8 Claims, 11 Drawing Sheets

PROCESS FRAME AND IMAGE FORMING APPARATUS COMPRISING SAME

INCORPORATION BY REFERENCE

This application is based on and claims the benefit of priority from Japanese Patent application No. 2016-196529 filed on Oct. 4, 2016, the entire contents of which are incorporated herein by reference.

BACKGROUND

The present disclosure relates to an image forming apparatus including a process unit in which a drum unit supporting a photosensitive drum and a development unit supporting a developing device are attachably/detachably provided.

An image forming apparatus, such as a printer or a copying machine, may be configured so that a drum unit rotatably supporting a photosensitive drum, a development unit supporting a developing device and an intermediate transferring unit rotatably supporting an intermediate transferring belt are installed to a process frame.

In such an image forming apparatus, positioning parts positioned to each unit and the process frame mutually are formed. In a case where each unit is installed to the process frame from an upper side, a positioning boss is formed in each unit and a U-shaped gap engageable with the boss is formed in the process frame. When each unit is installed to the process frame, the boss is inserted into the U-shaped gap from the upper side, and then, each unit is positioned to the process frame.

However, in a case where positioning is composed of the boss and the U-shaped gap as mentioned above, if the image forming apparatus is shocked by tumbling or falling upside down, it is feared that the boss is detached from the U-shaped gap. In order to prevent the boss from being detached, an inlet of the U-shaped gap may be formed smaller than a diameter of the positioning boss and the boss may be lightly press-fitted to the U-shaped gap. But, in a case where such lightly press-fitting is required, attaching and detaching of each unit take time and labor. Moreover, in a case where a shock applied to the image forming apparatus is large, it is difficult to surely position the boss to the U-shaped gap.

SUMMARY

In accordance with the present disclosure, an image forming apparatus includes a drum unit, a development unit and a process frame. The drum unit supports a photosensitive drum. The development unit forms a toner image on the photosensitive drum. In the process frame, after the development unit is installed along a predetermined installation direction, the drum unit is installed along the installation direction. The process frame includes a pair of two supporting parts supporting a pair of two supported parts provided in the development unit. One of the supporting parts is configured so as to support one of the supported parts along a direction intersecting the installation direction and to restrict movement of one of the supported parts along the installation direction. Other of the supporting parts is configured to restrict movement of other of the supported parts along the installation direction when, after the other of the supported parts is supported along the installation direction, the drum unit is installed to the process frame.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the drawings, an image forming apparatus according to an embodiment of the present disclosure will be described.

Figure 1:
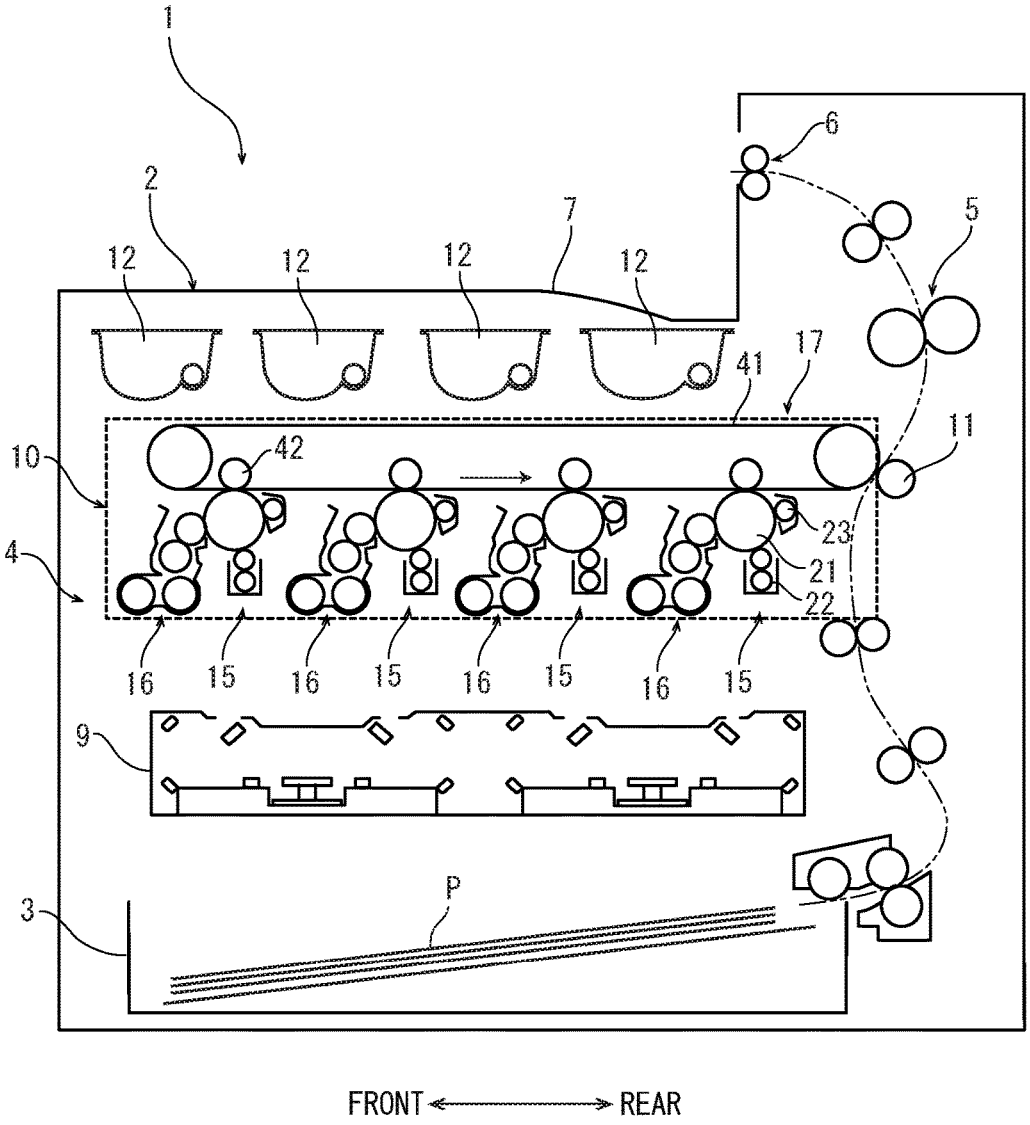
FIG. 1 is a sectional view schematically showing an internal structure of a color printer according to an embodiment of the present disclosure.

Firstly, the entire structure of a color printer 1 as the image forming apparatus according to the embodiment will be described with reference to FIG. 1. FIG. 1 is a schematic view schematically showing the color printer 1. Hereinafter, it will be described so that a front side (a front face side) of the color printer 1 is a left side on a paper sheet of FIG. 1 and left and right directions are defined on the basis of a direction viewed the color printer 1 from the front side.

In an apparatus body 2 of the color printer 1, a sheet feeding cartridge 3 storing a sheet P, an image forming part 4 forming a full-color toner image on the sheet P, a fixing device 5 fixing the toner image on the sheet P, an ejecting device 6 ejecting the sheet P having the fixed toner image, and an ejection tray 7 receiving the ejected sheet P are provided. The sheet P is fed out from the sheet feeding cartridge 3 and is subjected to transferring of the full-color toner image in the image forming part 4, and then, is subjected to fixing of the toner image in the fixing device 5 and is ejected onto the ejection tray 7 from the ejecting device 6.

The image forming part 4 includes an exposing device 9, a process unit 10, a secondary transferring roller 11 and toner containers 12 respectively containing toners of four colors (yellow, magenta, cyan, black).

Figure 2:
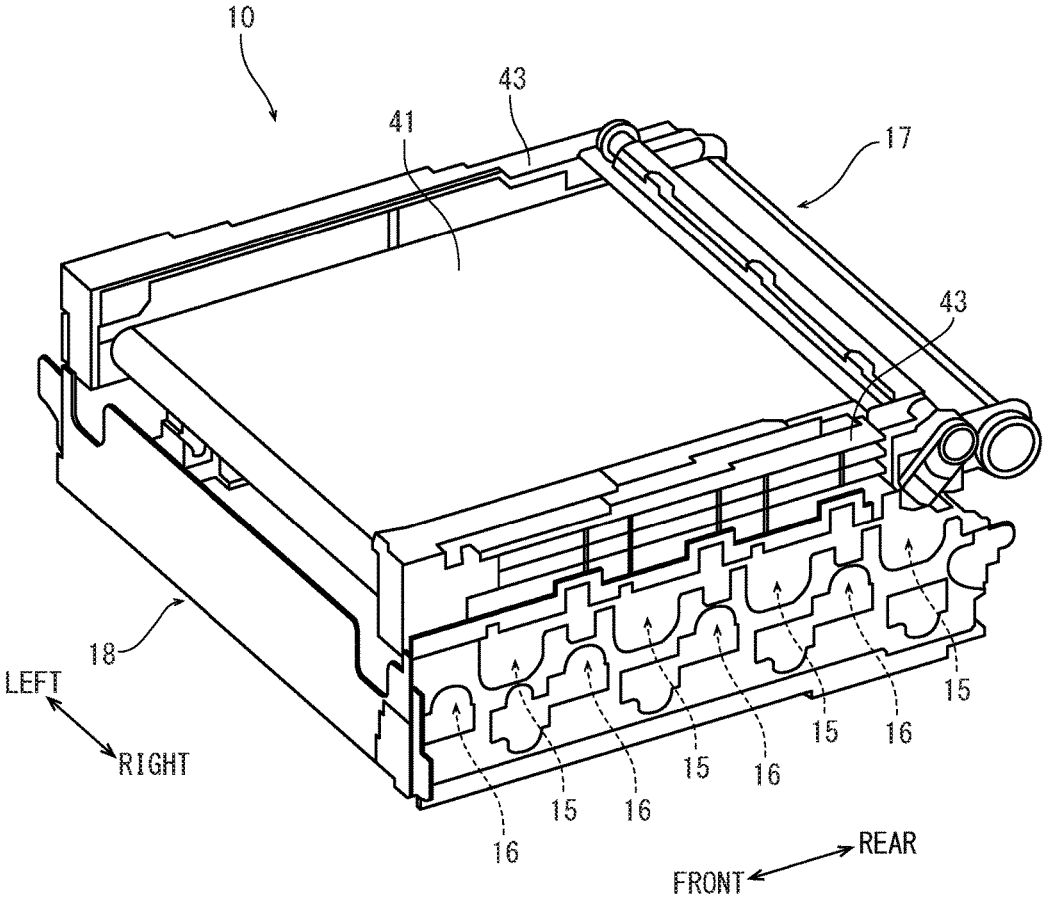
FIG. 2 is a perspective view showing a process unit of the color printer according to the embodiment of the present disclosure.
Figure 3:
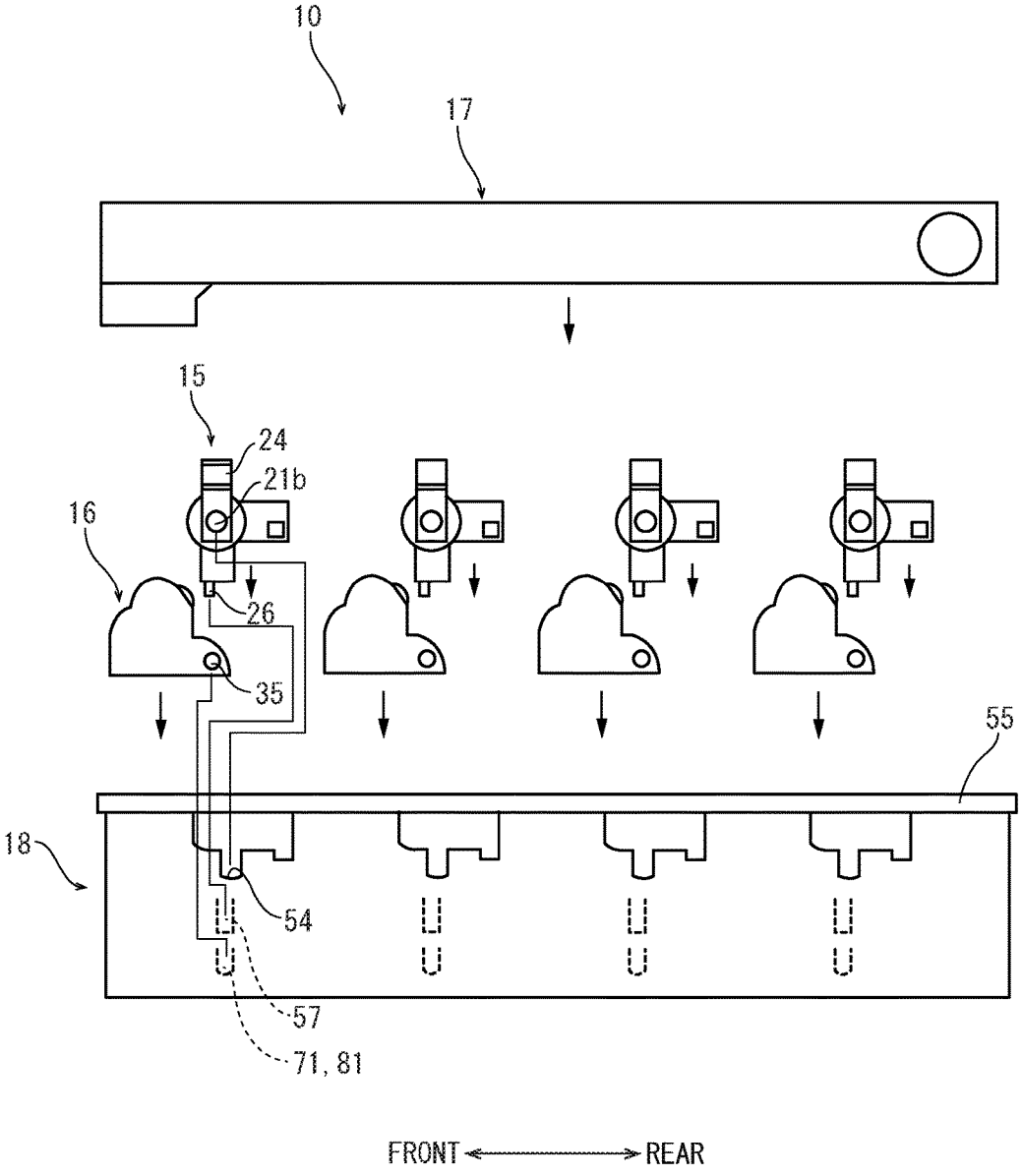
FIG. 3 is an exploded sectional view showing the process unit of the color printer according to the embodiment of the present disclosure.

Next, with reference to FIGS. 2-3 in addition to FIG. 1, the process unit 10 will be described. FIG. 2 is a perspective view showing the process unit 10. FIG. 3 is a side face view schematically showing the exploded process unit 10.

As shown in each figure, the process unit 10 includes drum units 15 and development units 16 provided for the respective toners of four colors, an intermediate transferring unit 17 and a process frame 18. As shown in FIG. 3, the development unit 16, the drum unit 15 and the intermediate transferring unit 17 are installed to the process frame 18 from an upper side in this order.

Figure 4:
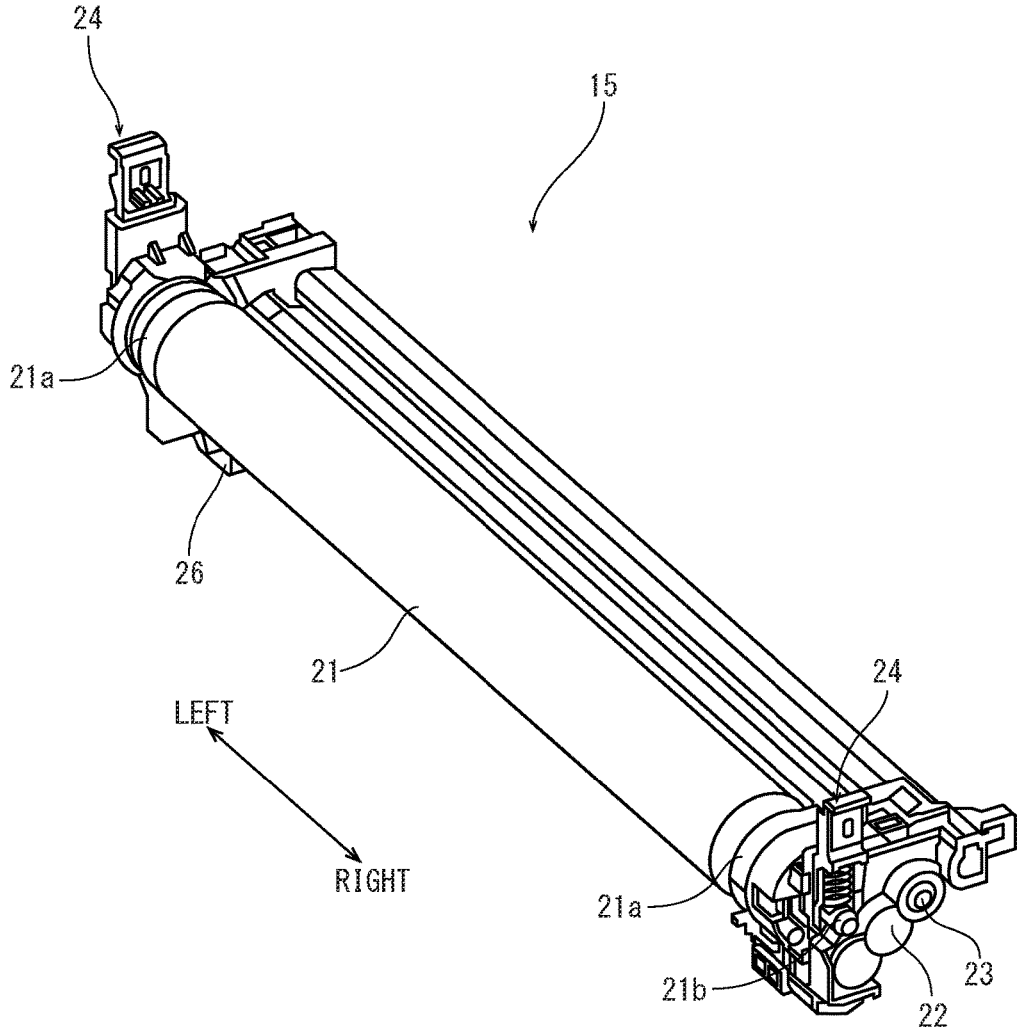
FIG. 4 is a perspective view showing a drum unit of the color printer according to the embodiment of the present disclosure.

First, the drum unit 15 will be described with reference to FIG. 4. FIG. 4 is a perspective view showing the drum unit 15. The drum unit 15 includes a photosensitive drum 21 rotatably arranged, a charging device 22 and a cleaning device 23 arranged along an outer circumference face of the photosensitive drum 21 in order, and a pair of locking members 24.

In opening portions at both ends of the photosensitive drum 21, respective flange members 21*a* are fixedly attached. Between the flange members 21*a*, a rotating shaft 21*b* passing through an axial center of the photosensitive drum 21 is penetrated. The pair of locking members 24 are respectively inserted into both ends of the rotating shaft 21*b*. Moreover, on a lower face of a left end of the photosensitive drum 21, a rectangular parallelepiped shape positioning protrusion part 26 for positioning is formed so as to be protruded to a lower side.

Figure 5:
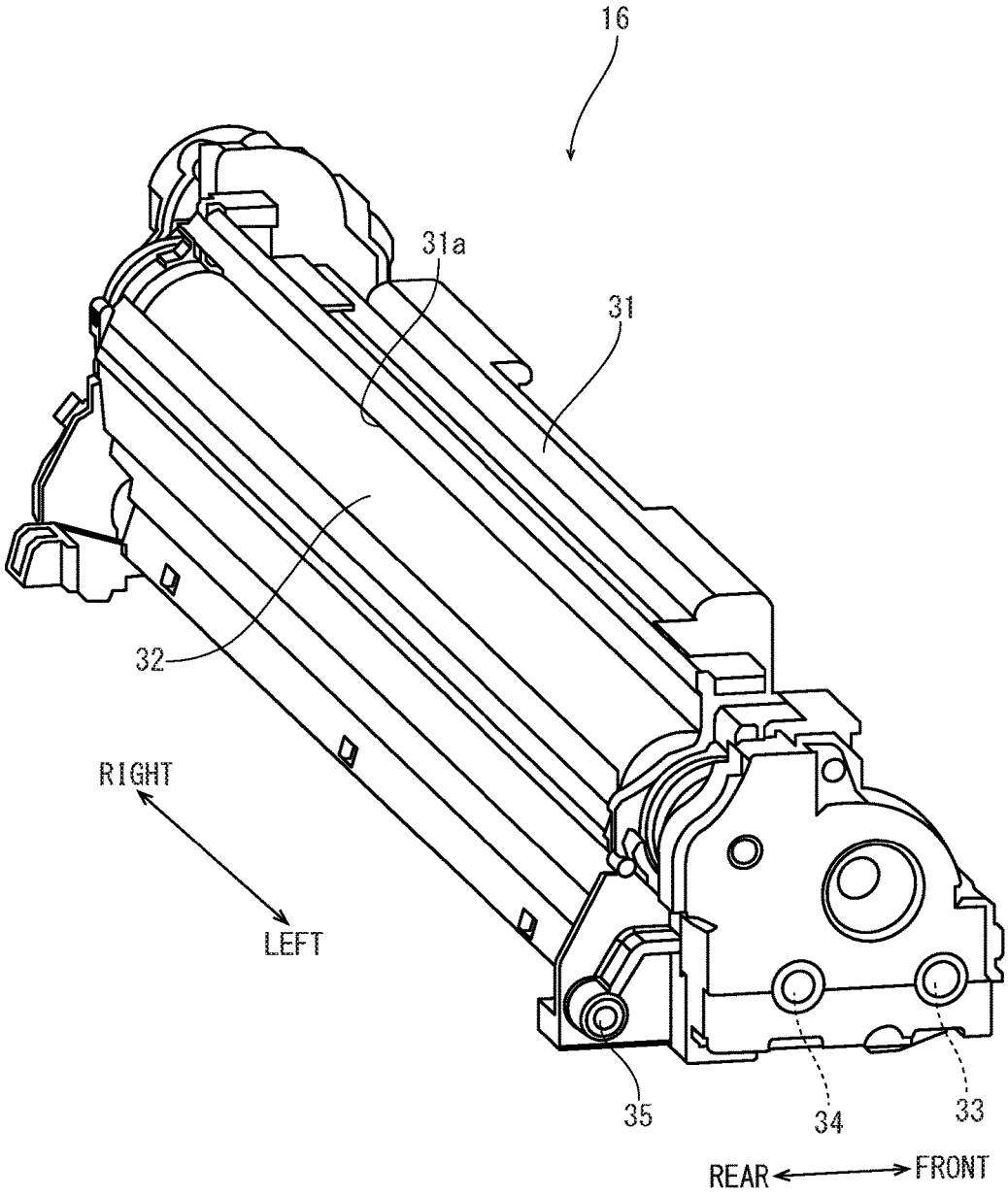
FIG. 5 is a perspective view showing a development unit of the color printer according to the embodiment of the present disclosure.

Next, the development unit 16 will be described with reference to FIG. 5. FIG. 5 is a perspective view showing the development unit 16. The development unit 16 includes a development case 31 and a magnetic roller 32.

The development case 31 is a case storing a developer supplied from the corresponding toner container 12 and, in its upper part, an opening part 31*a* along the left and right directions is formed. The magnetic roller 32 is supported by the development case 31 so as to be exposed from the opening part 31*a* and to be rotated. The developer stored in the development case 31 is agitated by an agitating conveyance screw 33, and then, is supplied to the magnetic roller 32 by a supplying conveyance screw 34.

In the development case 31, at rear lower corner of left and right side faces, a pair of bosses 35 coaxially protruded along opposite directions to each other in the left and right directions are formed as a supported part of a structure that the development unit 16 is supported by the process frame 18.

Next, the intermediate transferring unit 17 will be described with reference to FIGS. 1 and 2. The intermediate transferring unit 17 includes an endless intermediate transferring belt 41 circulatively running, four primary transferring rollers 42 located in a hollow portion of the intermediate transferring belt 41, and a frame 43 supporting these.

Figure 6:
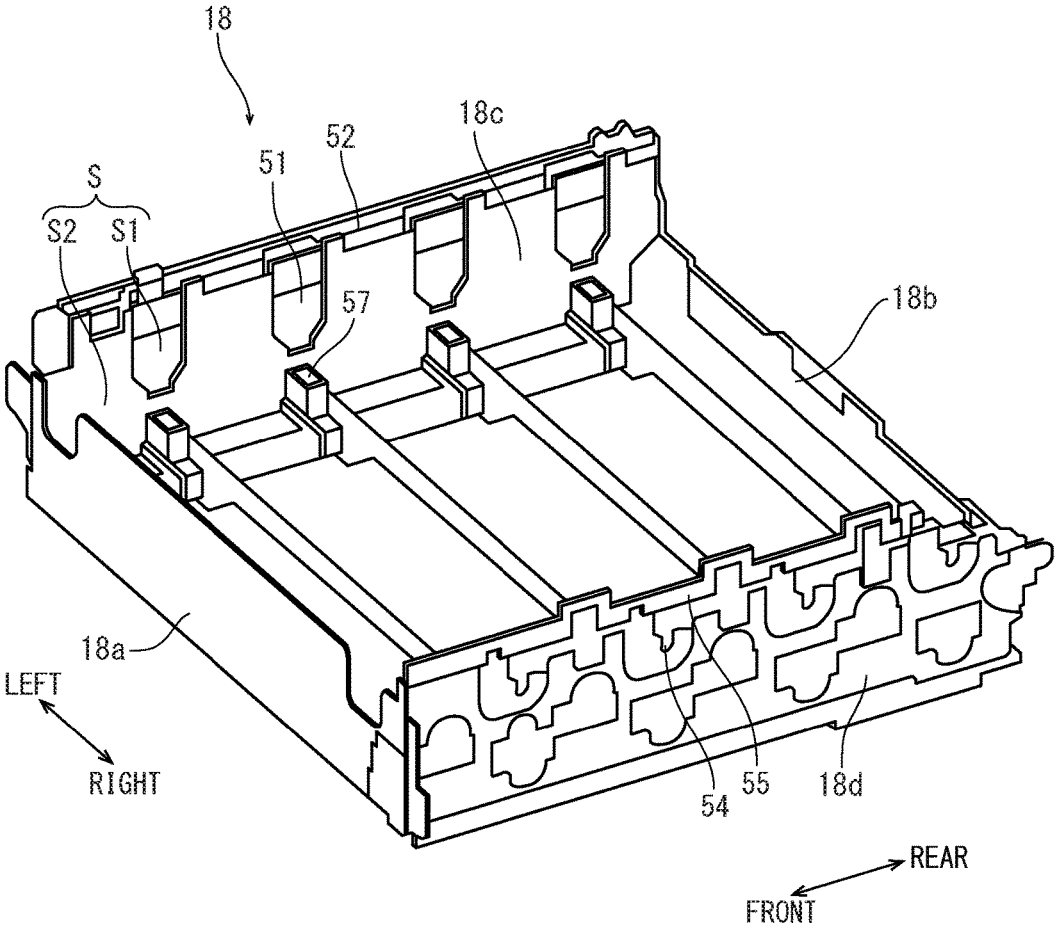
FIG. 6 is a perspective view showing a process frame of the color printer according to the embodiment of the present disclosure.

Next, the process frame 18 will be described with reference to FIG. 6. FIG. 6 is a perspective view showing the process frame 18. The process frame 18 is a rectangular tube frame member having a front board 18*a* and a back board 18*b* facing to each other in forward and backward directions and a left board 18*c* and a right board 18*d* facing to each other in the left and right directions. In a hollow portion of the process frame 18, four installation divisions S are arranged in the forward and backward directions. Each of the installation divisions S has each of drum unit installation divisions S1, in which each drum unit 15 is installed, and each of development unit installation divisions S2, in which each development unit 16 is installed.

In each of the drum unit installation divisions S1, on the left board 18*c*, a flange receiving part 51 cut out from an upper end to a lower side is formed. The flange receiving part 51 has a rectangular shape and its lower end is formed in an inverted trapezoidal shape tapering toward a lower side. In addition, to an outer face of the left board 18*c*, a left engaging plate 52 is fixedly attached so as to be across an upper portion of the flange receiving part 51. On the other hand, on the right board 18*d*, a bearing groove 54 from an upper end to a lower side is formed. In addition, to an outer face of the right board 18*d*, a right engaging plate 55 is fixedly attached so as to be across an upper portion of the bearing groove 54.

Further, in the drum unit installation division S1, at a lower side of the flange receiving part 51 of the left board 18*c*, a positioning recessed part 57 for drum unit positioning is formed. The positioning recessed part is formed in a rectangular tube shape elongated in upward and downward directions and its upper and lower ends are opened.

Figure 7:
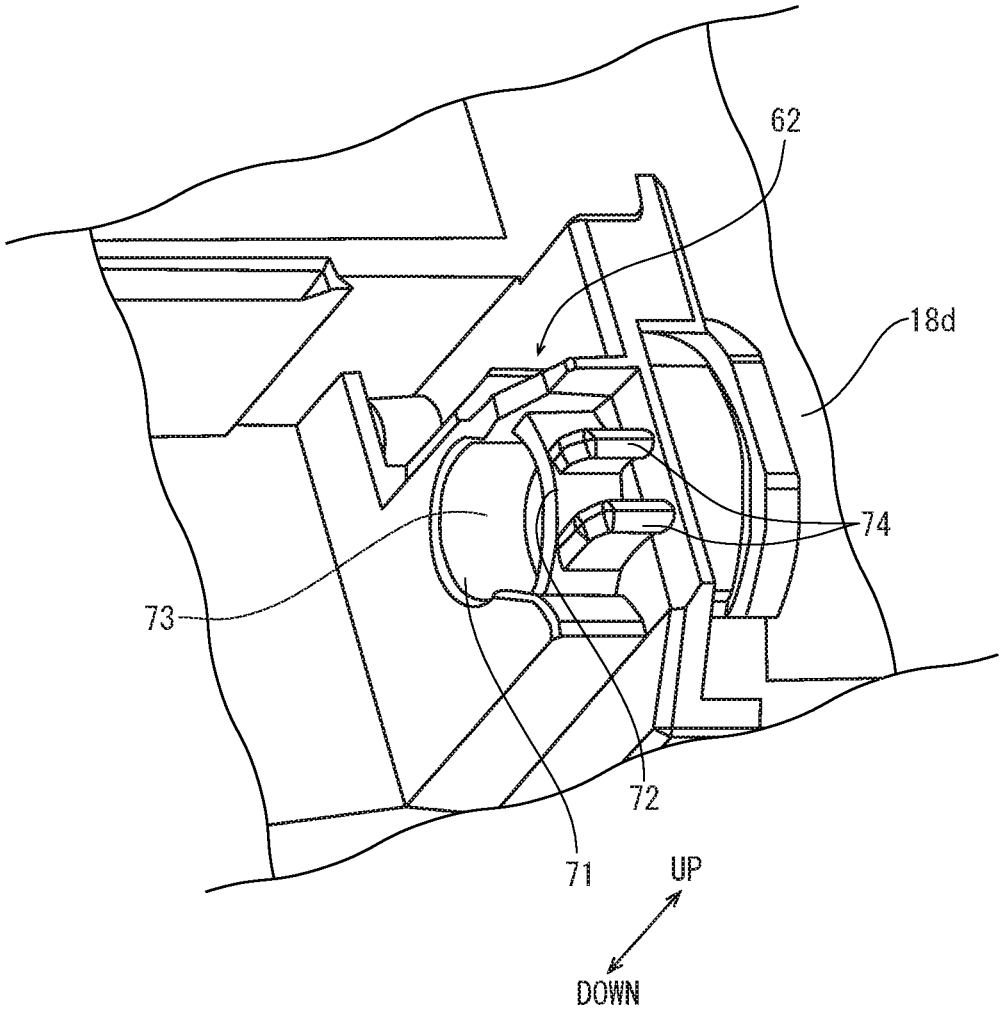
FIG. 7 is a perspective view showing a right supporting part of the process frame supporting a right boss of the drum unit in the color printer according to the embodiment of the present disclosure.
Figure 8A:
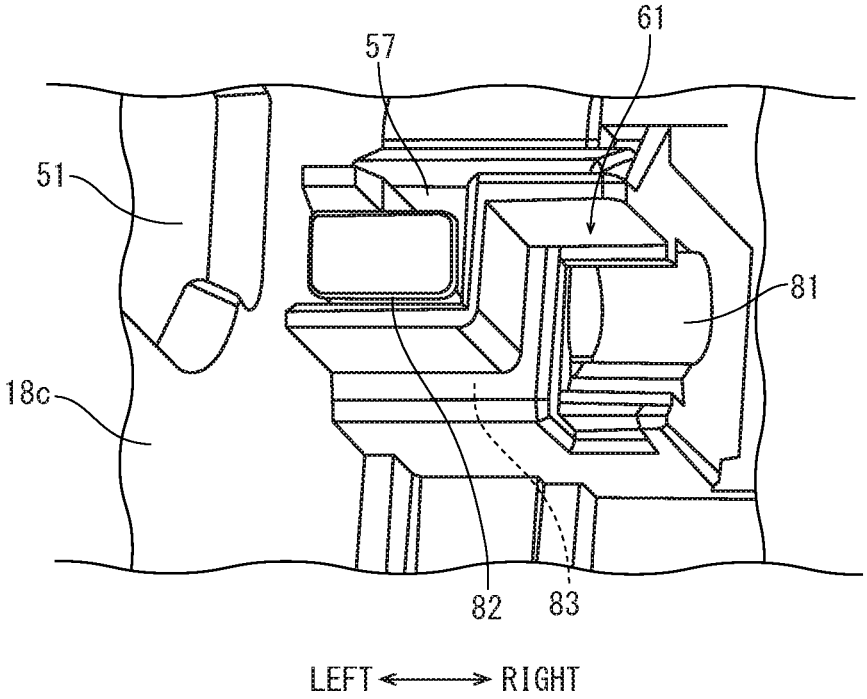
FIG. 8A is a perspective view showing a left supporting part of the process frame supporting a left boss of the drum unit, in a state that a lever member is not pressed, in the color printer according to the embodiment of the present disclosure.
Figure 8B:
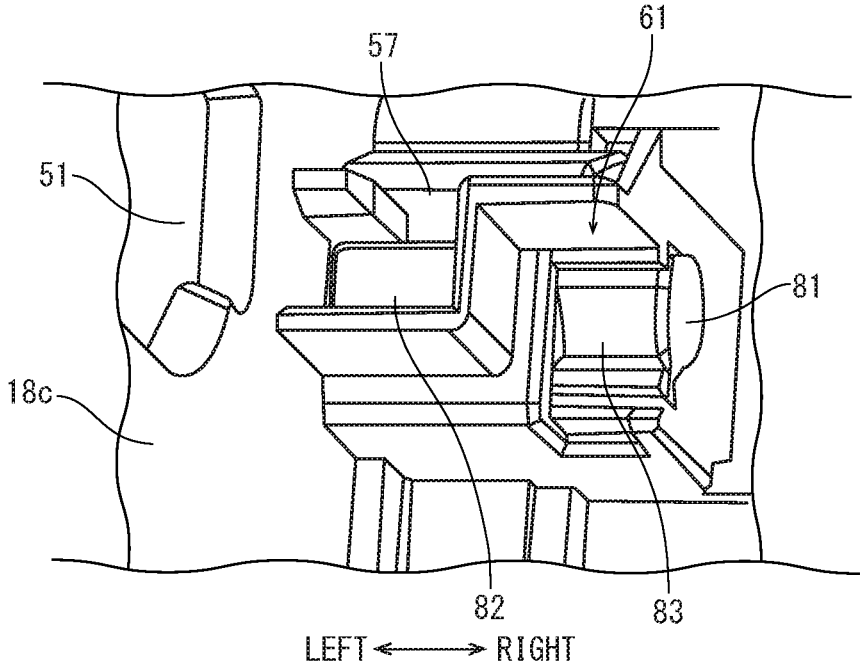
FIG. 8B is a perspective view showing the left supporting part of the process frame supporting the left boss of the drum unit, in a state that the lever member is pressed, in the color printer according to the embodiment of the present disclosure.

In the development unit installation division S2, on the left board 18*c* and the right board 18*d*, left and right supporting part 61 and 62 respectively supporting the pair of bosses 35 of the development unit 16 are formed (refer to FIGS. 7, 8A and 8B).

First, the right supporting part 62 will be described with reference to FIG. 7. FIG. 7 is a perspective view of the right supporting part 62 as viewed from an upper side. The right supporting part 62 has a gap part 71 formed along the left and right directions and having an opened upper end, and an upwardly protruded and arc-shaped rib 72 formed so as to close the upper end of the gap part 71. That is, the gap part 71 and the rib 72 compose an engaging recessed part 73 recessed in the left and right directions and formed in a roughly circle shape as viewed from the front side.

Figure 9A:
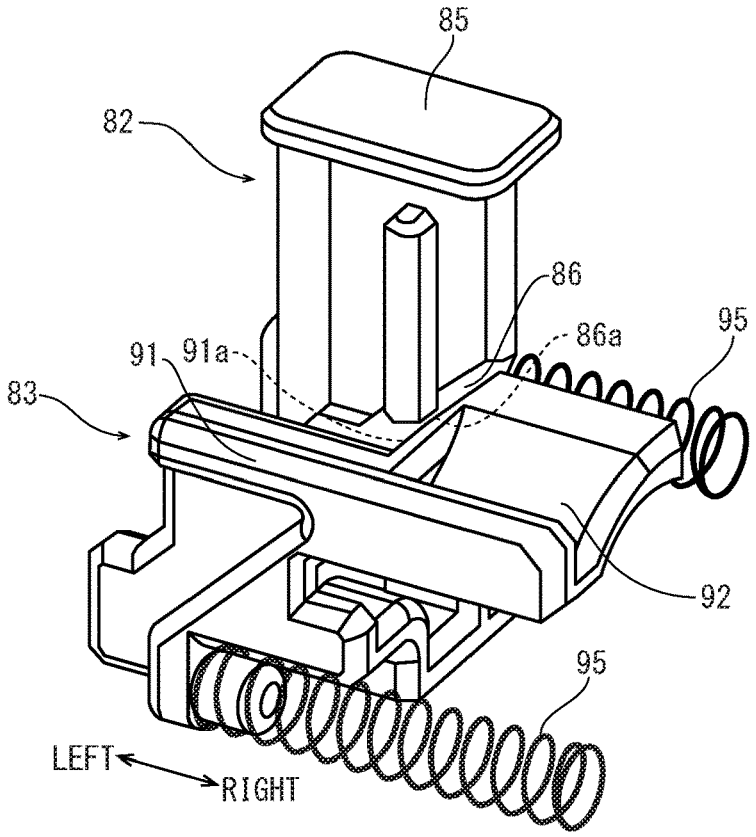
FIG. 9A is a perspective view showing the lever member and a locking member of the left supporting part, in a state that the lever member is not pressed, in the color printer according to the embodiment of the present disclosure.
Figure 9B:
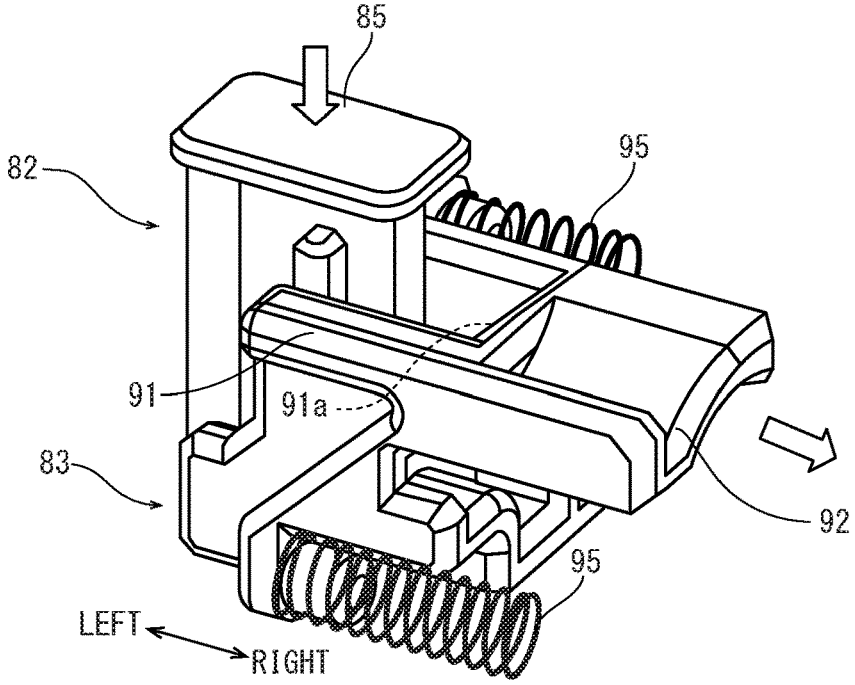
FIG. 9B is a perspective view showing the lever member and the locking member of the left supporting part, in a state that the lever member is pressed, in the color printer according to the embodiment of the present disclosure.

Next, the left supporting part 61 will be described with reference to FIGS. 8A, 8B, 9A and 9B. FIGS. 8A and 8B are perspective views of the left supporting part 61 as viewed from an upper side and FIGS. 9A and 9B are perspective views showing a lever member 82 and a locking member 83. The left supporting part 61 has a gap part 81, the lever member 82 and the locking member 83.

As shown in FIGS. 8A and 8B, the gap part 81 is formed along the upward and downward directions and has an opened upper end. The gap part 81 is formed at the inside from the positioning recessed part 57 and at a lower side of the positioning recessed part 57.

As shown in FIGS. 9A and 9B, the lever member 82 is a member housed in the positioning recessed part 57 and, on its upper end face, a head part 85 formed in a rectangular plate shape is provided and, on its lower end face, a pressing part 86 is provided. On the pressing part 86, an inclined face 86*a* (a first inclined face) directed to a right upper side (inclined upwardly toward a side of a lock position) is formed. The lever member 82 is supported, as shown in FIGS. 8A and 8B, inside the positioning recessed part 57 so as to be slidable in the upward and downward directions. The lever member 82 is slid in the upward and downward directions between an upper position (refer to FIG. 8A) where it is housed in the positioning recessed part 57 and a lower position (refer to FIG. 8B) where the pressing part 86 is protruded to a lower side from the positioning recessed part 57. In the upper position shown in FIG. 8A, the head part 85 closes an opening of an upper face of the positioning recessed part 57. If the head part 85 is pressed to the lower side, the lever member 82 is slid from the upper position to the lower position.

The locking member 83 has, as shown in FIGS. 9A and 9B, a pressed part 91 and a closing part 92 arranged in the left and right directions. On the pressed part 91, an inclined face 91*a* (a second inclined face) directed to a left lower side (inclined downwardly toward a side of an unlock position) is formed in a shape capable of coming into contact with the inclined face 86*a* of the lever member 82. The closing part 92 is formed in an arc shape capable of closing the upper end of the gap part 81. The locking member 83 is supported at a lower side of the positioning recessed part 57 so as to be slidable in the left and right directions. That is, the locking member 83 is slid in the left and right directions between the unlock position (refer to FIGS. 8A and 9A) where the pressed part 91 is positioned at the lower side of the positioning recessed part 57 and the lock position (refer to FIGS. 8B and 9B) where the pressed part 91 is separated from the lower side of the positioning recessed part 57 to the right side. In the unlock position, the closing part 92 is withdrawn from the upper end of the gap part 81 and, in the lock position, the closing part 92 closes the upper end of the gap part 81.

Further, the locking member 83 is biased to the unlock position by coil springs 95. Thereby, the inclined face 91*a* of the pressed part 91 comes into contact with the inclined face 86*a* of the pressing part 86 of the lever member 82, and then, the lever member 82 is slid to the upper position. If the head part 85 of the lever member 82 is pressed downwardly inside the positioning recessed part 57, the inclined face 91*a* of the pressed part 91 is pressed by the inclined face 86*a* of the pressing part 86, and then, the locking member 83 is slid to the lock position against a biasing force of the coil springs 95. Thereby, the upper end of the gap part 81 is closed by the closing part 92.

Figure 10A:
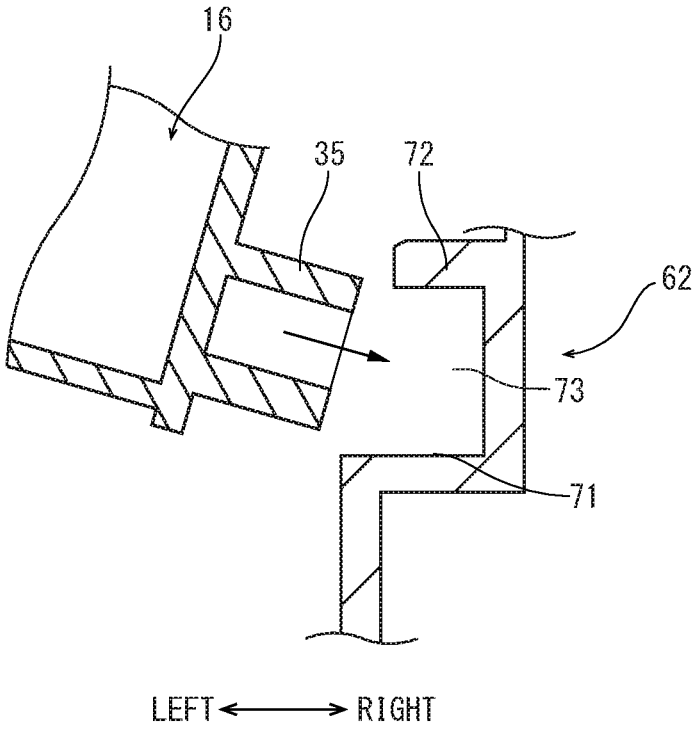
FIG. 10A is a lateral sectional view showing the boss and the supporting part, in a state that the boss is being inserted into an engaging recessed part, in a step supporting the right boss by the right supporting part in the color printer according to the embodiment of the present disclosure.
Figure 10B:
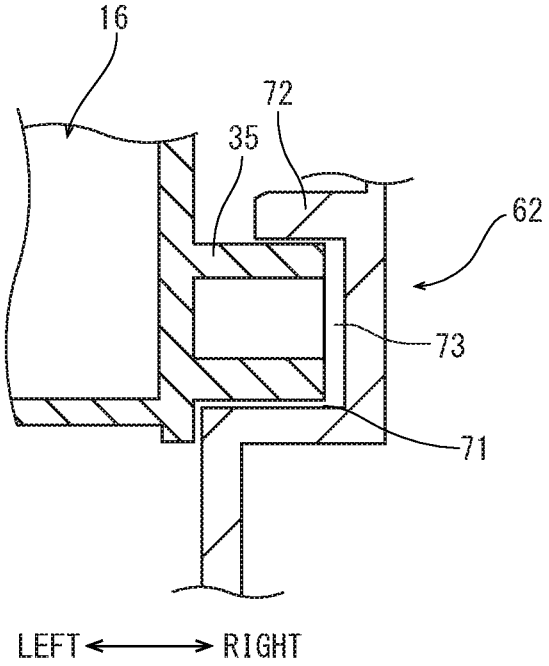
FIG. 10B is a lateral sectional view showing the boss and the supporting part, in a state that the boss is fitted into the engaging recessed part, in the step supporting the right boss by the right supporting part in the color printer according to the embodiment of the present disclosure.

A procedure installing the development units 16, the drum units 15 and the intermediate transferring unit 17 having the above-described configuration to the process frame 18 will be described with reference to FIGS. 3, 10A, 10B 11A, 11B and 11C. FIGS. 10A and 10B are figures used for explaining a step supporting the drum unit 15 by the right supporting part 62 and FIGS. 11A, 11B and 11C are figures used for explaining a step supporting the drum unit 15 by the left supporting part 61.

First, each development unit 16 is installed to each development unit installation division S2 of the process frame 18. At this time, as shown in FIG. 10A, the development unit 16 is inclined so that its right end is directed to a lower side, the right boss 35 is inserted into the engaging recessed part 73 of the right supporting part 62 and, as shown in FIG. 10B, the boss 35 is pivotally supported by the engaging recessed part 73. That is, the right boss 35 is inserted into the engaging recessed part 73 along a right obliquely downward direction being a direction intersecting the downward direction as an installation direction (from an oblique upper side). By thus inclining the development unit 16, it is possible to pivotally support the boss 35 by the engaging recessed part 73 without interfering in the rib 72. Moreover, detaching of the boss 35 from the engaging recessed part 73 is prevented by the rib 72 and movement of the boss 35 along the installation direction is restricted.

Figure 11A:
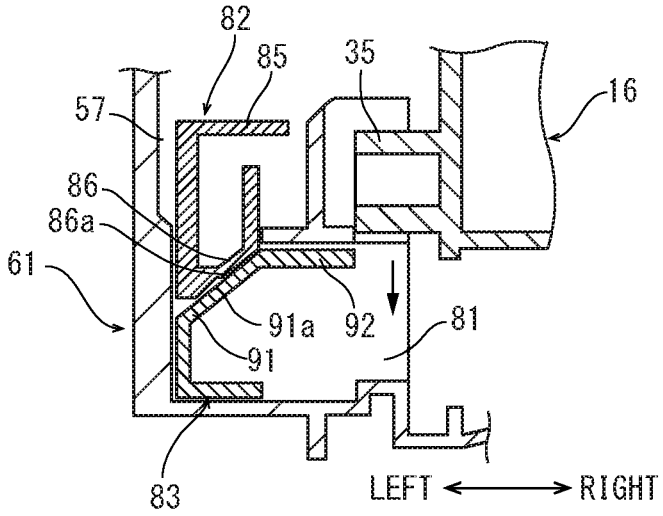
FIG. 11A is a lateral sectional view showing the boss and the supporting part, in a state that the boss is being inserted into a gap part, in a step supporting the left boss by the left supporting part in the color printer according to the embodiment of the present disclosure.
Figure 11B:
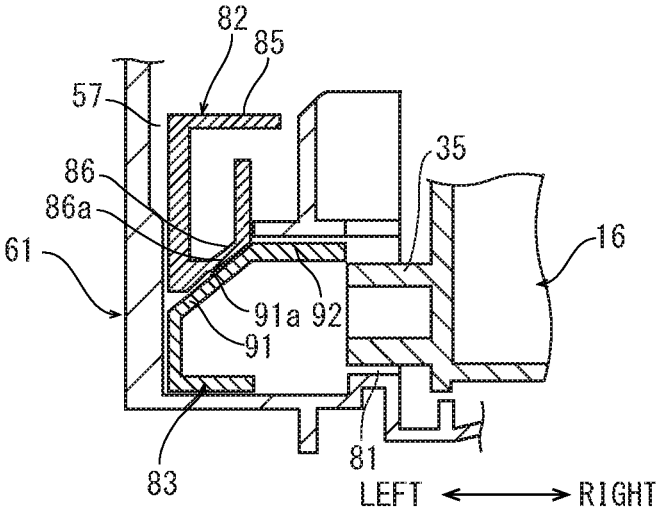
FIG. 11B is a lateral sectional view showing the boss and the supporting part, in a state that the boss is supported by the gap part, in the step supporting the left boss by the left supporting part in the color printer according to the embodiment of the present disclosure.
Figure 11C:
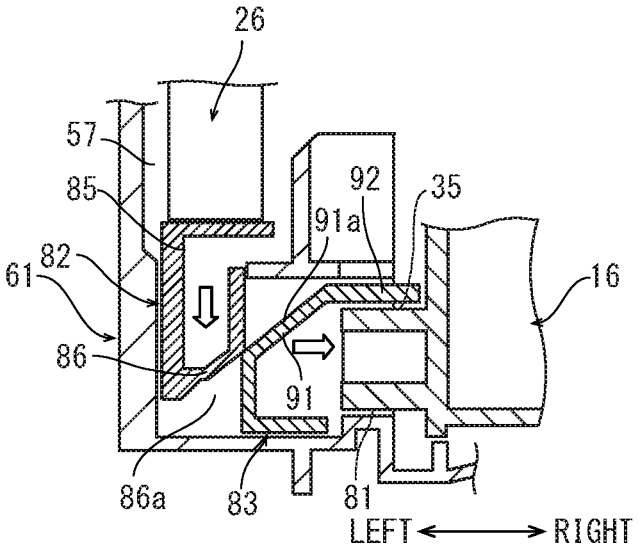
FIG. 11C is a lateral sectional view showing the boss and the supporting part, in a state that an upper end of the gap part is closed by the locking member, in the step supporting the left boss by the left supporting part in the color printer according to the embodiment of the present disclosure.

Subsequently, a left end of the development unit is turned downwardly around the right boss 35 as a fulcrum, as shown in FIG. 11A, the left boss 35 is inserted into the gap part 81 of the left supporting part 61 along the upward and downward directions (from an upper side) and, as shown in FIG. 11B, the left boss 35 is pivotally supported by the gap part 81. At this time, because the locking member is slid to the unlock position, it is possible to insert the boss 35 into the gap part 81 from the upper side without interfering in the rib 72. Thereby, in the development unit 16, the left and right bosses 35 are pivotally supported by the gap part 81 and the engaging recessed part 73 of the left and right supporting part 61 and 62, respectively (refer to FIG. 3). Incidentally, the development unit 16 is whirl-stopped by a whirl-stopping part provided in the development case 31 and a whirl-stopping part provided in the development unit installation division S2.

Next, each drum unit 15 is installed to each drum unit installation division S1 from the upper side. At this time, the left flange member 21*a* of the drum unit 15 is fitted into the flange receiving part 51, and then, the locking member 24 is engaged with the left engaging plate 52. Simultaneously, as shown in FIG. 3, a right end of the rotating shaft 21*b* of the drum unit 15 is inserted into the bearing groove 54, and then, the locking member 24 is engaged with the right engaging plate 55. Further, the positioning protrusion part 26 is inserted into the positioning recessed part 57, and then, the drum unit 15 is positioned and whirl-stopped.

When the positioning protrusion part 26 is thus inserted into the positioning recessed part 57, as shown in FIG. 11C, the head part 85 of the lever member 82 is pressed down by the positioning protrusion part 26 and the lever member 82 is slid downwardly. Thereupon, the inclined face 86*a* of the pressing part 86 of the lever member 82 presses the inclined face 91*a* of the pressed part 91 of the locking member 83, and then, the locking member 83 is slid from the unlock position to the lock position against the biasing force of the coil springs 95 (not shown in FIG. 11C). Thereby, the upper end of the gap part 81 is closed by the closing part 92, detaching of the left boss 35 from the gap part 81 is prevented, and movement of the boss 35 along the installation direction is restricted. Incidentally, the locking member 83 is maintained at the lock position by the lever member 82 slid to the lower position by the positioning protrusion part 26 of the drum unit 15. Thereby, when the left boss 35 is inserted into the gap part 81 along the installation direction, it is possible to prevent the boss 35 from coming off from the gap part 81 by the locking member 83 due to installation of the drum unit 15.

Finally, the intermediate transferring unit 17 is installed to the process frame 18 from the upper side with respect to the drum units 15 and the development units 16. At this time, a positioning part provided in the intermediate transferring unit 17 is engaged with a positioning part of the process frame 18, and then, the intermediate transferring unit 17 is positioned.

The process unit 10, in which the development units 16, the drum units 15 and the intermediate transferring unit 17 are thus installed to the process frame 18, is attachably/detachably supported by the apparatus body 2.

When the process unit 10 is installed to the apparatus body 2, and then, image data is inputted from an image inputting device, first, in each drum unit 15 of the process unit 10, a surface of the photosensitive drum 21 is electrically charged by the charging device 22, and subsequently, is exposed on the basis of the image data by the exposing device 9. Thereby, respective electrostatic latent images are formed on surfaces of the respective photosensitive drum 21. The electrostatic latent images are developed to respective toner images of corresponding colors by the respective development units 16. The respective toner images are successively primary-transferred to the intermediate transferring belt 41 by the primary transferring rollers 42, and then, are secondary-transferred to the sheet P by the secondary transferring roller 11. The full-color toner image is fixed to the sheet P by being heated and pressured by the fixing device 5, and then, the sheet P is ejected onto the ejection tray 7. The toner remained on the surface of the photosensitive drum 21 is removed by the cleaning device 23.

When the development unit 16 is detached from the process unit 10, if the intermediate transferring unit 17 is detached, and then, the drum unit 15 is pulled out to the upper side, the positioning protrusion part 26 is separated from the positioning recessed part 57, and accordingly, a force having pressed the lever member 82 is released. Thereby, the lever member 82 becomes slidable to the upper position and the locking member 83 is biased from the lock position to the unlock position by the coil spring 95. According to this, it is possible to extract the left boss 35 of the drum unit 15 from the gap part 81 to the upper side. After the left boss 35 of the drum unit 15 is extracted from the gap part 81 to the upper side, the development unit 16 is slanted in a left obliquely upward direction, and then, the right boss 35 is extracted from the gap part 71.

As described above, in the process unit 10 of the color printer 1 of the present disclosure, the left and right bosses 35 of the development unit 16 are prevented from coming off from the gap part 81 and the engaging recessed part 73 of the left and right supporting part 61 and 62 of the process frame 18. In detail, it is impossible to extract the right boss 35 from the engaging recessed part 73 by the rib 72 and it is impossible to extract the left boss 35 from the gap part 81 by the closing part 92 of the locking member 83. Therefore, even if the color printer 1 is shocked by tumbling or falling upside down during conveyance, the left and right bosses 35 are not extracted from the left and right supporting part 61 and 62, respectively. Thereby, it is possible to leave the development unit 16 positioned to the process frame 18.

Incidentally, although, in the present embodiment, the right supporting part 62 is composed of the gap part 71 and the rib 72, it may be composed of a shaft hole recessed in the left and right directions.

Moreover, the locking member 82 is configured so as to be slid from the unlock position to the lock position through the lever member 82 pressed by the drum unit 15. If the locking member 82 were configured so as to be slid directly by the drum unit 15, due to displacement or deviation of installation of the drum unit 15, it is feared that the lock member 83 is not stably slid. However, by the configuration through the lever member 82, regardless of any installation manner of the drum unit 15, it is possible to stably slide the locking member 83.

Further, the lever member 82 is configured so as to be supported slidably along the upward and downward directions by the positioning recessed part 57 into which the positioning protrusion part 26 of the drum unit 15 is fitted and to be pressed by the positioning protrusion part 26. Therefore, it is unnecessary to provide an exclusive member for pressing the lever member 82 and supporting the lever member 82, and then, it is possible to simplify the configuration of the drum unit 15 and the process frame 18.

Incidentally, although, in the present embodiment, the pair of bosses 35 are formed as the supported part provided in the development unit 16 and the engaging recessed part 73 and the gap part 81 are formed as the supporting part provided in the process frame 18, structure of the supported part and the supporting part is not restricted by these. For example, the supported part may be formed as an engaging recessed part and a gap part and the supporting part may be formed as bossed respectively inserted into the engaging recessed part and the gap part. Moreover, although the installation direction of the development unit 16 and the drum unit 15 was described as the upward and downward directions, the installation direction may be, for example, an oblique direction or a horizontal direction. In such a case, the pair of bosses may be formed along a direction intersecting the installation direction, the engaging recessed part may be formed in a direction intersecting the installation direction and the gap part may be formed along the installation direction.

Incidentally, the above-description of the embodiment of the present disclosure was described about a preferable embodiment of the image forming apparatus according to the disclosure. Therefore, although there were cases where technically preferable various definitions were applied, the technical scope of the present disclosure is not limited to the embodiments, unless limitation of the disclosure is specified. Components in the embodiment described above can be appropriately exchanged with existing components, and various variations including combinations with other existing components are possible. The description of the embodiment described above does not limit the content of the disclosure described in the claims.

The invention claimed is:

1. An image forming apparatus comprising:

a drum unit supporting a photosensitive drum;

a development unit forming a toner image on the photosensitive drum; and a process frame in which, after the development unit is installed along a predetermined installation direction, the drum unit is installed along the installation direction, wherein the process frame includes:

a pair of two supporting parts supporting a pair of two supported parts provided in the development unit, one of the supporting parts is configured so as to support one of the supported parts along a direction intersecting the installation direction and to restrict movement of one of the supported parts along the installation direction, other of the supporting parts is configured to restrict movement of other of the supported parts along the installation direction when, after the other of the supported parts is supported along the installation direction, the drum unit is installed to the process frame.

2. The image forming apparatus according to claim 1, wherein the drum unit and the development unit are installed to the process frame along upward and downward directions as the installation direction, the pair of two supported parts have:

a pair of two bosses protruded in the direction intersecting the upward and downward directions, the one of the supporting parts has:

an engaging recessed part recessed in the direction intersecting the upward and downward directions, the other of the supporting parts has:

a gap part formed along the upward and downward directions and having an opened upper end; and a locking member slidable between a lock position where the locking member closes the upper end of the gap part and an unlock position where the locking member is withdrawn from the upper end, when, after one of the bosses is inserted into the engaging recessed part from an oblique upper side and then other of the bosses is inserted into the gap part from an upper side, the drum unit is installed to the process frame, the locking member is slid from the unlock position to the lock position to prevent the other of the bosses from coming off from the gap part.

3. The image forming apparatus according to claim 2 further comprising:

a lever member sliding the locking member from the unlock position to the lock position when being pressed by the drum unit.

4. The image forming apparatus according to claim 3, wherein in the drum unit and the process frame, a positioning protrusion part and a positioning recessed part into which the positioning protrusion part is fitted are respectively formed, the lever member is supported slidably along the upward and downward directions by the positioning recessed part, when the positioning protrusion part is fitted into the positioning recessed part, the lever member is pressed by the positioning protrusion part to slide the locking member from the unlock position to the lock position.

5. The image forming apparatus according to claim 4, wherein the locking member includes:

a closing part provided at a side of the lock position; and a pressed part provided at a side of the unlock position, when the pressed part is pressed by the lever member, the locking member is slid to the side of the lock position and the closing part closes the upper end of the gap part.

6. The image forming apparatus according to claim 5, wherein on a lower end face of the lever member, a first inclined face inclined upwardly toward the side of the lock position is formed, on the pressed part of the locking member, a second inclined face inclined downwardly toward the side of the unlock position is formed in a shape capable of coming into contact with the first inclined face.

7. The image forming apparatus according to claim 6, wherein the locking member is biased to the side of the unlock position by the coil spring.

8. The image forming apparatus according to claim 2, wherein the engaging recessed part is composed of a gap part formed along the direction intersecting the upward and downward directions and having an opened upper end and a rib formed so as to close the upper end of the gap part of the engaging recessed part.

* * * * *